US008726866B1

(12) United States Patent
Lichti

(10) Patent No.: US 8,726,866 B1
(45) Date of Patent: May 20, 2014

(54) CHECK VALVE FOR A CAMSHAFT PHASER

(71) Applicant: Delphi Technologies, Inc., Troy, MI (US)

(72) Inventor: Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/782,052

(22) Filed: Mar. 1, 2013

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31; 137/625.32
See application file for complete search history.

(56) References Cited

U.S. PATENT DOCUMENTS

| | | | | |
|---|---|---|---|---|
| 6,571,757 | B1 * | 6/2003 | Simpson | 123/90.11 |
| 6,871,621 | B2 | 3/2005 | Palesch et al. | |
| 6,883,481 | B2 | 4/2005 | Gardner et al. | |
| 2008/0264200 | A1 | 10/2008 | Hoppe et al. | |
| 2009/0159829 | A1 | 6/2009 | Hoppe et al. | |
| 2010/0065138 | A1 | 3/2010 | Hoffmann | |
| 2010/0294387 | A1 | 11/2010 | Scheidig et al. | |

FOREIGN PATENT DOCUMENTS

| | | | |
|---|---|---|---|
| WO | 2006/127347 | A1 | 11/2006 |
| WO | 2010/066552 | A1 | 6/2010 |

* cited by examiner

*Primary Examiner* — Zelalem Eshete
(74) *Attorney, Agent, or Firm* — Thomas N. Twomey

(57) ABSTRACT

A camshaft phaser for controllably varying the phase relationship between a crankshaft and a camshaft in an internal combustion engine is attached to the camshaft with a camshaft phaser attachment bolt. The camshaft phaser attachment bolt includes a stepped bore for communicating pressurized oil from the internal combustion engine to a valve spool and is defined by a larger diameter bore, a smaller diameter bore, and a shoulder between the larger diameter bore and the smaller diameter bore. A check valve assembly includes a check valve body axially moveable within the larger diameter bore. The check valve body includes a plurality of azimuthally spaced guiding walls, a plurality of clearance walls separating the guiding walls, and a seating surface at one end of the guiding walls and the clearance walls for selectively seating with the shoulder to prevent fluid communication between the larger diameter bore and the smaller diameter bore.

23 Claims, 5 Drawing Sheets

CHECK VALVE FOR A CAMSHAFT PHASER

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser, even more particularly to a vane-type camshaft phaser which includes a an oil control valve located in a camshaft phaser attachment bolt that is used to attach the camshaft phaser to the camshaft, and still even more particularly to a check valve located within the camshaft phaser attachment bolt.

BACKGROUND OF INVENTION

A typical vane-type camshaft phaser generally comprises a plurality of outwardly-extending vanes on a rotor interspersed with a plurality of inwardly-extending lobes on a stator, forming alternating advance and retard chambers between the vanes and lobes. Oil is selectively supplied and vented to and from the advance and retard chambers in order to achieve a desired phase relationship between the rotor and the stator, and consequently, a desired phase relationship between a camshaft and a crankshaft of an internal combustion engine. The supply and venting of oil to and from the advance and retard chambers is typically controlled by a valve spool. For packaging benefits the valve spool may be positioned within a bore of a centrally located camshaft phaser attachment bolt which is used to attach the camshaft phaser to the camshaft. United States Patent Application Publication number 2012/0060787 A1 shows such a camshaft phaser with the valve spool located within the centrally located camshaft phaser attachment bolt. In order to filter oil being supplied to the valve spool and in order to prevent oil from flowing backward from the valve spool to the oil source, a combination filter and check valve is provided within the same bore as the valve spool. The filter includes two annular sections separated from each other and connected by four struts. A cylindrical filter fabric is arranged around the struts between the two annular sections. A check valve body in the form of a ball is positioned within the struts and the struts act to guide the ball axially. When pressure within the camshaft phaser is elevated to a pressure that is higher than the oil source, the ball is seated against a shoulder in the bore to prevent backflow of oil to the oil source. While this filter and check valve arrangement may be compact, the location of the filter within the camshaft phaser attachment bolt renders the filter unserviceable in the event the filter becomes plugged during operation. The location of the filter also renders the available filter area to be small which may make the filter susceptible to plugging.

What is needed is a camshaft phaser which minimizes or eliminates one or more of the shortcomings set forth above. What is also needed is a check valve and filter arrangement for a camshaft phaser which minimizes or eliminates or more of the shortcomings set forth above.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and connectable to the crankshaft of the internal combustion engine to provide a fixed ratio of rotation between the stator and the crankshaft. The camshaft phaser also includes a rotor coaxially disposed within the stator and having a plurality of vanes interspersed with the stator lobes defining alternating advance chambers and retard chambers. The advance chambers receive pressurized oil in order to change the phase relationship between the crankshaft and the camshaft in the advance direction and the retard chambers receive pressurized oil in order to change the phase relationship between the camshaft and the crankshaft in the retard direction. The rotor is attachable to the camshaft of the internal combustion engine to prevent relative rotation between the rotor and the camshaft. A camshaft phaser attachment bolt extends coaxially through the rotor and threadably engages the camshaft to attach the camshaft phaser to the camshaft. The camshaft phaser attachment bolt includes a stepped bore for communicating pressurized oil from the internal combustion engine to a valve spool and is defined by a larger diameter bore, a smaller diameter bore, and a shoulder between the larger diameter bore and the smaller diameter bore. A check valve assembly is included to prevent oil from being communicated from the valve spool to the internal combustion engine. The check valve assembly includes a check valve body axially moveable within the larger diameter bore and a spring for biasing the check valve body toward the shoulder. The check valve body includes a plurality of azimuthally spaced guiding walls, a plurality of clearance walls separating the guiding walls, and a seating surface at one end of the guiding walls and the clearance walls for selectively seating with the shoulder to prevent fluid communication between the larger diameter bore and the smaller diameter bore. The guiding walls ride closely against the larger diameter bore and the clearance walls are spaced inward from the larger diameter bore to allow oil to flow between the clearance walls and the larger diameter bore when the seating surface is not seated with the shoulder.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
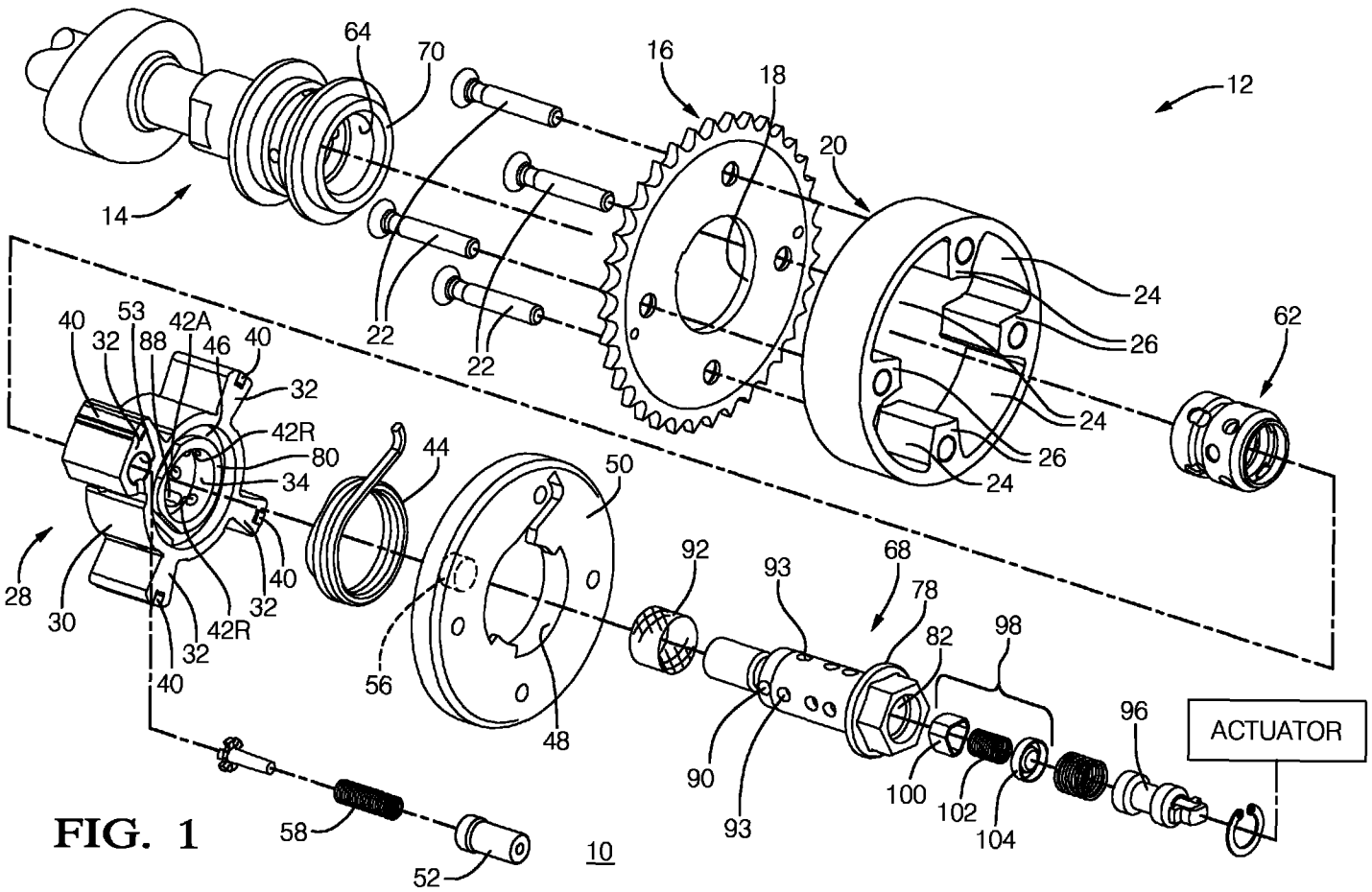
FIG. 1 is an exploded isometric view of a camshaft phaser in accordance with the present invention.
Figure 2:
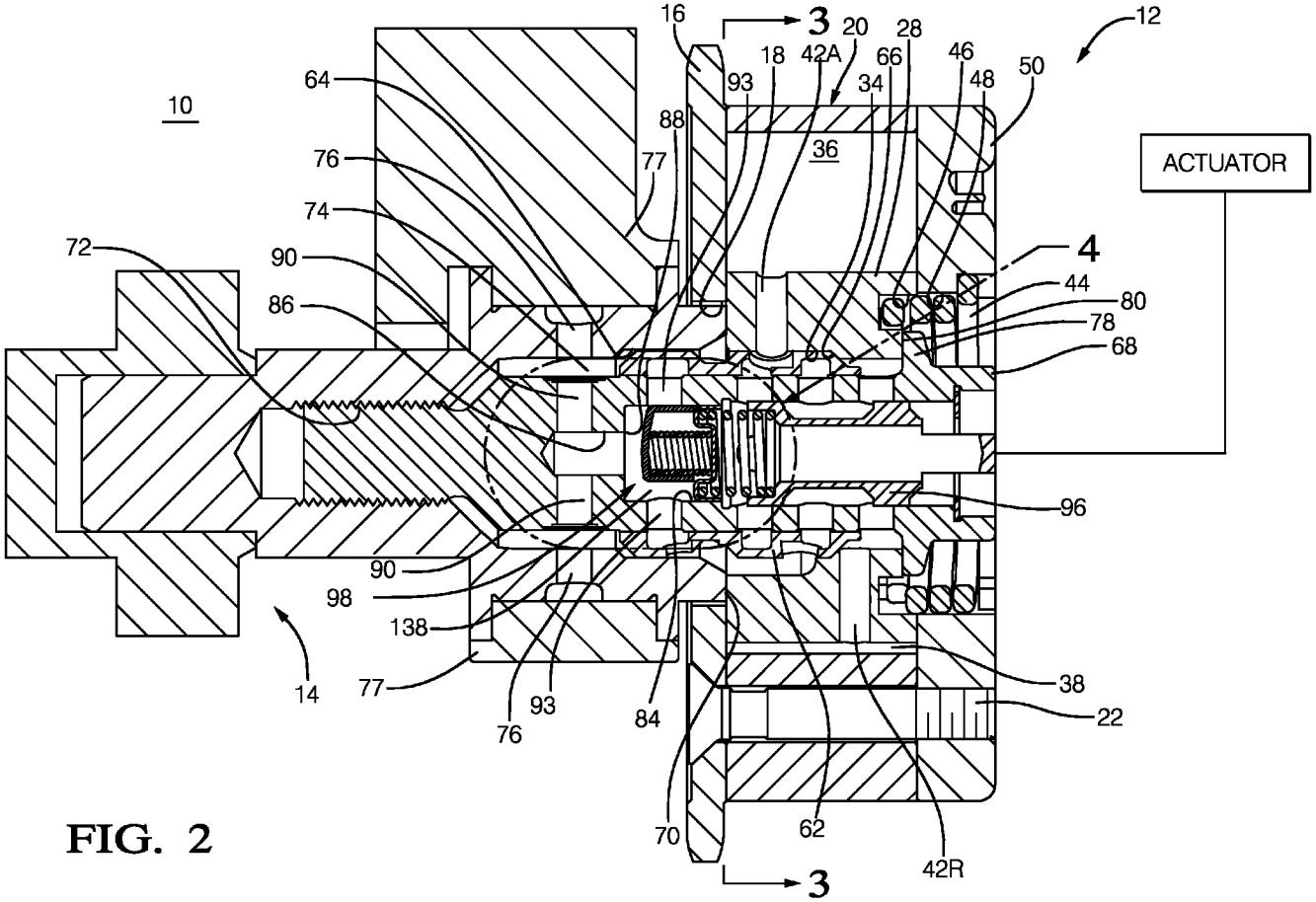
FIG. 2 is an axial cross-section of the camshaft phaser of FIG. 1.

In accordance with a preferred embodiment of this invention and referring to FIGS. 1-5, internal combustion engine 10 is shown which includes camshaft phaser 12. Internal combustion engine 10 also includes camshaft 14 which is rotatable based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and exhaust valves can be advanced or retarded in order to achieve desired engine performance.

Camshaft phaser 12 includes sprocket 16 which is driven by a chain or gear (not shown) driven by the crankshaft of internal combustion engine 10. Alternatively, sprocket 16 may be a pulley driven by a belt. Sprocket 16 includes a central bore 18 for receiving camshaft 14 coaxially therethrough which is allowed to rotate relative to sprocket 16. Sprocket 16 is sealingly secured to stator 20 with sprocket bolts 22 in a way that will be described in more detail later.

Stator 20 is generally cylindrical and includes a plurality of radial chambers 24 defined by a plurality of lobes 26 extending radially inward. In the embodiment shown, there are four lobes 26 defining four radial chambers 24, however, it is to be understood that a different number of lobes may be provided to define radial chambers equal in quantity to the number of lobes.

Rotor 28 includes central hub 30 with a plurality of vanes 32 extending radially outward therefrom and central through bore 34 extending axially therethrough. The number of vanes 32 is equal to the number of radial chambers 24 provided in stator 20. Rotor 28 is coaxially disposed within stator 20 such that each vane 32 divides each radial chamber 24 into advance chambers 36 and retard chambers 38. The radial tips of lobes 26 are mateable with central hub 30 in order to separate radial chambers 24 from each other. Preferably, each of the radial tips of vanes 32 includes one of a plurality of wiper seals 40 to substantially seal adjacent advance and retard chambers 36, 38 from each other. Although not shown, each of the radial tips of lobes 26 may include a wiper seal similar in configuration to wiper seal 40.

Figure 3:
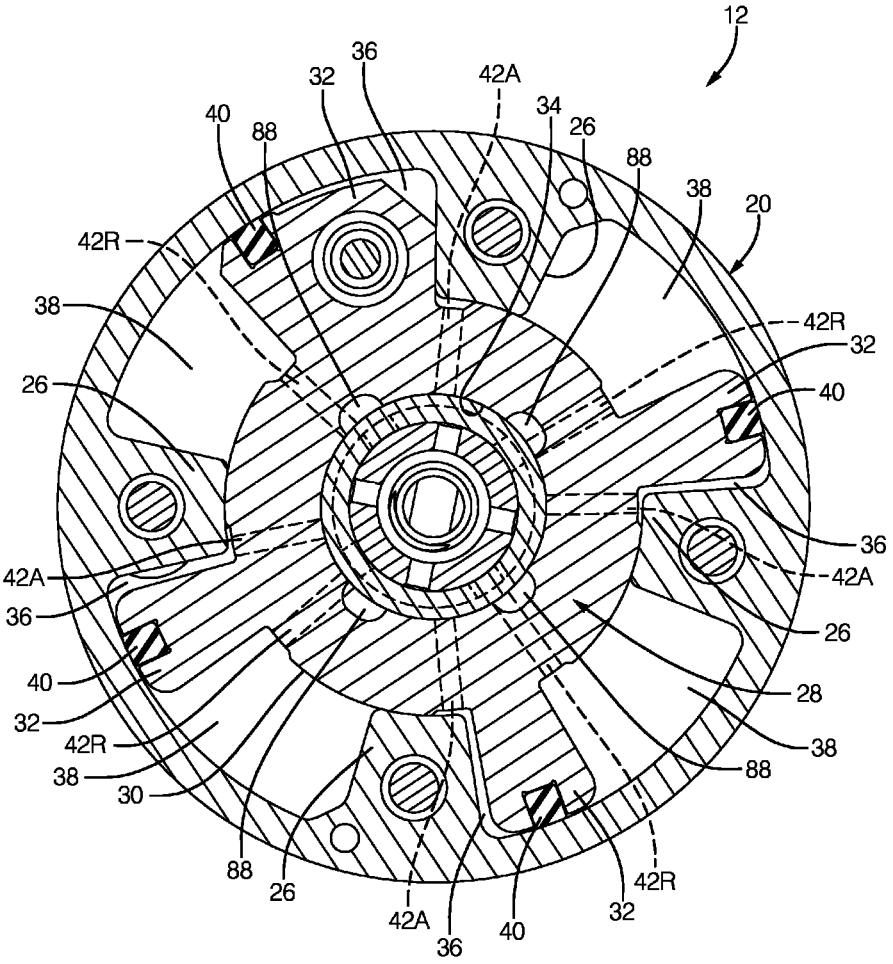
FIG. 3 is a radial cross-section of the camshaft phaser of FIGS. 1 and 2 taken in the direction of arrows 3 in FIG. 2.
Figure 4A:
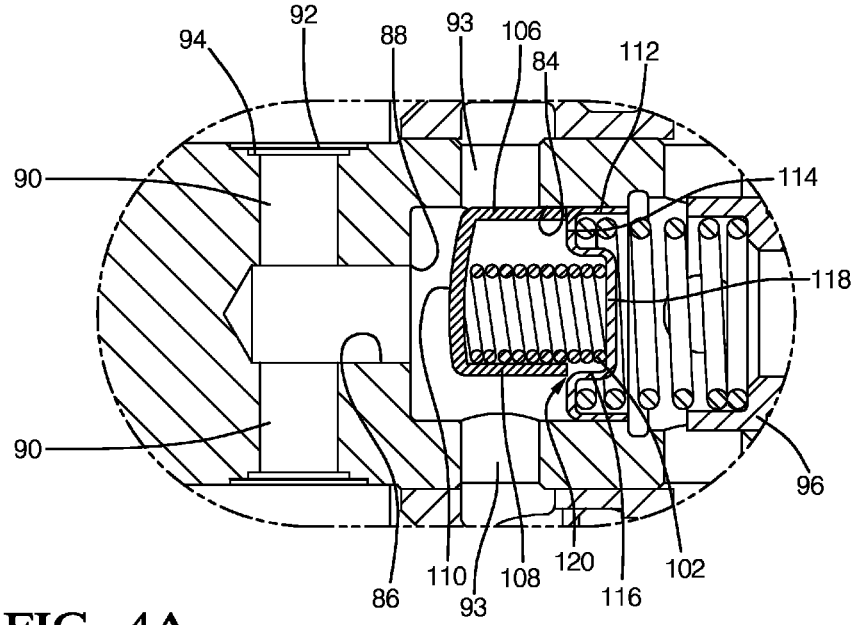
FIG. 4A is an enlarged view of a check valve assembly of FIG. 2 shown in an open position.
Figure 4B:
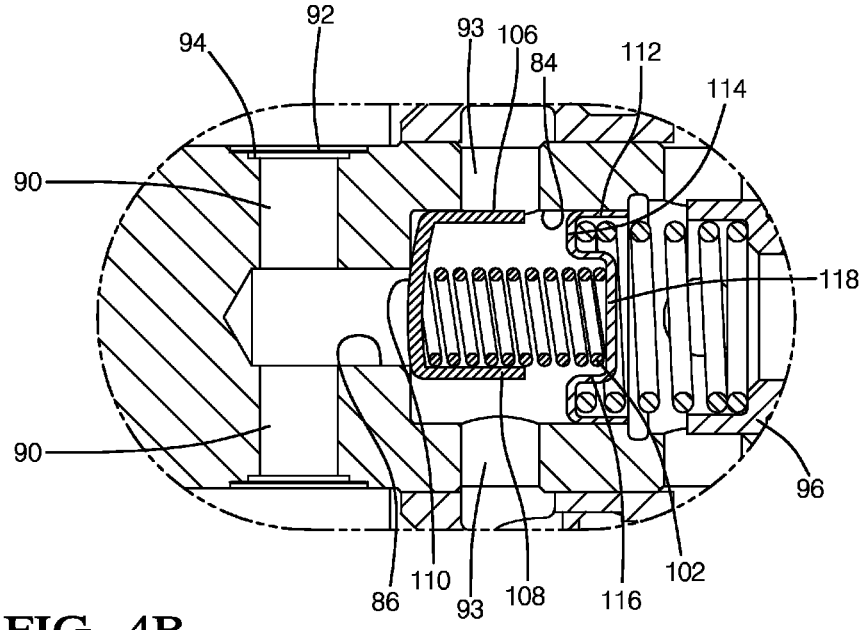
FIG. 4B is the check valve assembly of FIG. 4A shown in a closed position.
Figure 5:
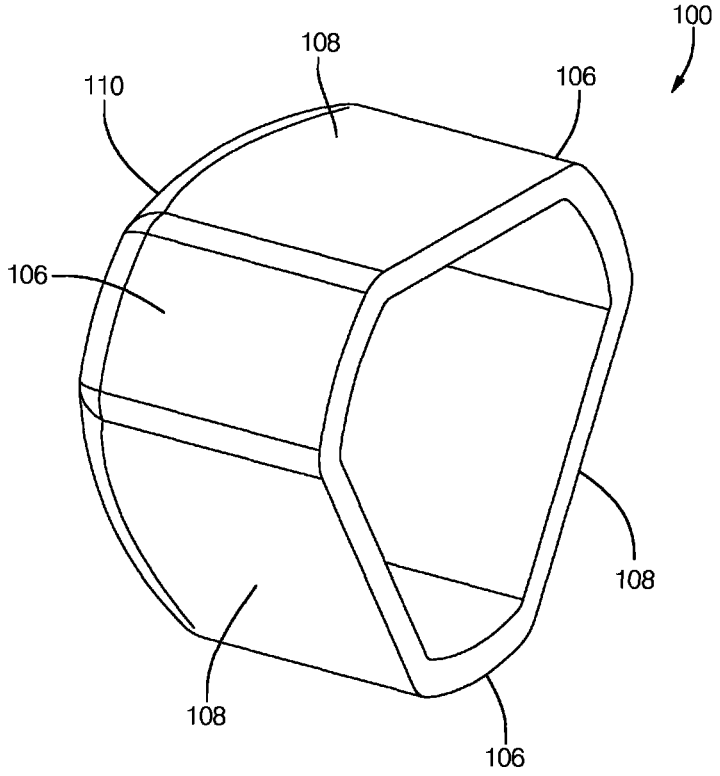
FIG. 5 is an isometric view of a check valve body of the check valve assembly of FIGS. 4A and 4B.

Central through bore 34 includes a plurality of oil passages 42A, 42R formed radially therethrough (best visible as hidden lines in FIG. 3). Each one of the plurality of oil passages 42A is in fluid communication with one of the advance chambers 36 for supplying oil thereto and therefrom while each one of the plurality of oil passages 42R is in fluid communication with one of the retard chambers 38 for supplying oil thereto and therefrom.

Bias spring 44 is disposed within annular pocket 46 formed in rotor 28 and within central bore 48 of camshaft phaser cover 50. Bias spring 44 is grounded at one end thereof to camshaft phaser cover 50 and is attached at the other end thereof to rotor 28. When internal combustion engine 10 is shut down, bias spring 44 urges rotor 28 to a predetermined angular position within stator 20 in a way that will be described in more detail in the subsequent paragraph.

Lock pin 52 is disposed within lock pin bore 54 formed in one of the plurality of vanes 32 of rotor 28. When internal combustion engine 10 is shut down, bias spring 44 urges rotor 28 into the predetermined position in which lock pin 52 is aligned with receiving hole 56 formed in camshaft phaser cover 50. Receiving hole 56 may include an insert which is made of a material that is more durable than camshaft phaser cover 50. Lock pin spring 58 urges lock pin 52 into receiving hole 56 when lock pin 52 is aligned with receiving hole 56 while internal combustion engine 10 is not running. In this way, rotor 28 is prevented from rotating relative to stator 20 and is therefore held in the predetermined position. When internal combustion engine 10 is running, oil is supplied at a sufficient pressure to act against lock pin 52, thereby compressing lock pin spring 58. In this way, lock pin 52 is retracted from receiving hole 56, thereby allowing rotor 28 to rotate relative to stator 20.

Camshaft phaser cover 50 is sealingly attached to stator 20 by sprocket bolts 22 that extend through sprocket 16 and stator 20 and threadably engage camshaft phaser cover 50. In this way, stator 20 is securely clamped between sprocket 16 and camshaft phaser cover 50 in order to axially and radially secure sprocket 16, stator 20, and camshaft phaser cover 50 to each other.

Bushing adaptor 62 is coaxially disposed within pocket 64 of camshaft 14 in a close fitting relationship. Bushing adaptor 62 is also coaxially disposed within central through bore 34 of rotor 28 in a press fit relationship to prevent relative rotation therebetween and may be press fit within central through bore 34 until bushing adaptor 62 abuts stop surface 66 of central through bore 34. When camshaft phaser 12 is attached to camshaft 14, bushing adaptor 62 coaxially aligns camshaft phaser 12 with camshaft 14. This allows the rotor 28 to be made more axially compact because axial space is not needed within rotor 28 for receiving camshaft 14 therewithin in order to coaxially align camshaft phaser 12 with camshaft 14. A network of oil passages is defined in part by bushing adaptor 62.

Camshaft phaser 12 is attached to camshaft 14 with camshaft phaser attachment bolt 68 which extends axially through bushing adaptor 62 in a close fitting relationship. Rotor 28 is positioned against axial face 70 of camshaft 14 which is provided with threaded hole 72 extending axially into camshaft 14 from pocket 64.

Annular oil chamber 74 is formed radially between camshaft phaser attachment bolt 68 and pocket 64 for receiving oil from camshaft oil passages 76 formed radially through camshaft 14. Oil is supplied to camshaft oil passages 76 from internal combustion engine 10 through an oil gallery (not shown) in a camshaft bearing 77. When camshaft phaser attachment bolt 68 is tightened to a predetermined torque, head 78 of camshaft phaser attachment bolt 68 acts axially on bolt surface 80 of rotor 28. In this way, camshaft phaser 12 is axially secured to camshaft 14 and relative rotation between rotor 28 and camshaft 14 is thereby prevented.

Camshaft phaser attachment bolt 68 includes stepped bore 82 having larger diameter bore 84 and smaller diameter bore 86. Shoulder 88 is located between larger diameter bore 84 and smaller diameter bore 86. First radial drillings 90 extend radially through camshaft phaser attachment bolt 68 to provide fluid communication between annular oil chamber 74 and smaller diameter bore 84. Filter 92 may be disposed circumferentially around camshaft phaser attachment bolt 68 in the area of first radial drillings 90 in order to prevent foreign matter that may be present in the pressurized oil from reaching smaller diameter bore 86. As shown, filter 92 is suspended above groove 94 formed circumferentially in camshaft phaser attachment bolt 68. First radial drillings 90 extend radially inward from groove 94. In this way, filter 92 provides a large filtering area in comparison to the area of first radial drillings 90 and consequently is less susceptible to plugging. Locating filter 92 on the exterior of camshaft phaser attachment bolt 68 also allows filter 92 to be easily cleaned or replaced by simply removing camshaft phaser attachment bolt 68. Second radial drillings 93 extend radially through camshaft phaser attachment bolt 68 to provide fluid communication between larger diameter bore 84 and valve spool 96 which is located in larger diameter bore 84. Second radial drillings 93 may be evenly spaced as shown. Valve spool 96 is used to direct pressurized oil to advance chambers 36 and retard chambers 38 as well as to vent oil from advance chambers 36 and retard chambers 38 as needed in order to achieve a desired camshaft phaser position. The operation of valve spool 96 as well as the oil passages used to route oil to valve spool 96 from second radial drillings 93 is described in United States Patent Application Publication number US 2012/0097122 A1 which is incorporated herein by reference in its entirety.

Check valve assembly 98 may be disposed within larger diameter bore 84 in order to allow pressurized oil to be supplied from internal combustion engine 10 to valve spool 96 while preventing oil from back-flowing from valve spool 96 to internal combustion engine 10. Check valve assembly 98 includes check valve body 100, check valve spring 102, and check valve spring seat 104.

Check valve body 100 is generally cup-shaped and moves axially within larger diameter bore 84. Check valve body 100 includes a plurality of guiding walls 106 and a plurality of clearance walls 108. Guiding walls 106 are all preferably equal in size and azimuthally spaced equally around check valve body 100. Guiding walls 106 ride closely with larger diameter bore 84 and are separated from each other by clearance walls 108. Clearance walls 108 are all preferably equal in size and spaced inward from larger diameter bore 84 in order to allow oil to pass between clearance walls 108 and larger diameter bore 84. In order to prevent all second radial drillings 93 from simultaneously being blocked by guiding walls 106, depending upon the radial orientation of check valve body 100, the quantity of guiding walls 106 is preferably not evenly divisible by the quantity of second radial drillings 93. It should be noted that the term "drillings" used herein is not intended to imply a process used to form features bearing the name.

Check valve body 100 also includes valve body seating surface 110 at one end of guiding walls 106 and clearance walls 108. Valve body seating surface 110 closes off the end of check valve body 100 that is proximal to smaller diameter bore 86 while the end of check valve body 100 that is distal from smaller diameter bore 86 is open to receive a portion of check valve spring 102 within check valve body 100. Check valve spring 102 may be radially supported within check valve body 100, for example, by an inside surface of clearance walls 108. Valve body seating surface 110 may be dome-shaped as shown and is sufficiently large to substantially prevent fluid communication between larger diameter bore 84 and smaller diameter bore 86 when seated against shoulder 88.

Check valve spring seat 104 is positioned across larger diameter bore 84 and separates and seals the portion of larger diameter bore 84 containing valve spool 96 from the portion of larger diameter bore 84 containing check valve assembly 98. Check valve spring seat 104 includes outer rim 112 which is sealed, for example by press fit, with larger diameter bore 84. Check valve spring seat 104 also includes end face 114 which is annular in shape and extends radially inward from the end of outer rim 112 that is proximal to check valve body 100. Check valve spring seat 104 also includes inner rim 116 which extends axially away from end face 114 toward valve spool 96. Check valve spring seat 104 also includes end cap 118 which is disk-shaped and spans across inner rim 116. The end of check valve spring 102 distal from check valve body 100 is disposed within inner rim 116 and seats on end cap 118. In this way, check valve spring 102 is grounded to camshaft phaser attachment bolt 68.

In operation, pressurized oil supplied from internal combustion engine 10 urges check valve body 100 away from shoulder 88, thereby compressing check valve spring 102. Guiding walls 106 serve to guide and center check valve body 100 within smaller diameter bore 86 during this movement. In this way, oil is filtered by filter 92, then the oil is passed through first radial drillings 90 to smaller diameter bore 86 before passing to larger diameter bore 84 and second radial drillings 93 where it is then communicated to valve spool 96. Clearance walls 108 provide space for sufficient oil flow between larger diameter bore 84 and check valve body 100 in order for a sufficient flow of oil to reach valve spool 96. Check valve body 100 may stop against check valve spring seat 104, and more particularly end face 114 of check valve spring seat 104. In order to prevent the internal volume of check valve body 100 from being sealed off when check valve body 100 stops against check valve spring seat 104, a relief passage 120 may be formed between check valve body 100 and check valve spring seat 104. As shown, relief passage 120 is formed by clearance walls 108 protruding radially inward sufficiently far of end face 114 of check valve spring seat 104 in order to prevent clearance walls 108 from sealing against end face 114. However, it should be understood that relief passage 120 could be formed in numerous ways. Relief passage 120 prevents check valve body 100 from being hydraulically locked in the open position. Check valve assembly 98 is shown in this operating condition in FIG. 4A. If, however, oil pressure within camshaft phaser 12 is greater than the oil pressure being supplied by internal combustion engine 10, check valve spring 102 together with oil pressure from camshaft phaser 12 will urge valve body seating surface 110 of check valve body 100 to seat against shoulder 88. In this way oil is prevented from back-flowing from valve spool 96 to internal combustion engine 10. Check valve assembly 98 is shown in this operating condition in FIG. 4B.

While this invention has been described in terms of preferred embodiments thereof, it is not intended to be so limited, but rather only to the extent set forth in the claims that follow.

I claim:

1. A camshaft phaser for controllably varying the phase relationship between a crankshaft and a camshaft in an internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator and having a plurality of vanes interspersed with said stator lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attachable to said camshaft of said internal combustion engine to prevent relative rotation between said rotor and said camshaft;

a camshaft phaser attachment bolt extending coaxially through said rotor and threadably engageable into said camshaft to attach said camshaft phaser to said camshaft, said camshaft phaser attachment bolt having a stepped bore for communicating pressurized oil from said internal combustion engine to said advance chambers and said retard chambers, said stepped bore defined by a larger diameter bore, a smaller diameter bore, and a shoulder between said larger diameter bore and said smaller diameter bore;

a check valve assembly to prevent oil from being communicated from said advance chambers and said retard chambers to said internal combustion engine, said check valve assembly comprising a check valve body axially moveable within said larger diameter bore;

wherein said check valve body includes a plurality of azimuthally spaced guiding walls, a plurality of clearance walls separating said guiding walls, and a seating surface at one end of said guiding walls and said clearance walls for selectively seating with said shoulder to prevent fluid communication between said larger diameter bore and said smaller diameter bore, said guiding walls riding closely against said larger diameter bore and said clearance walls spaced inward from said larger diameter bore to allow oil to flow between said clearance walls and said larger diameter bore when said seating surface is not seated with said shoulder.

2. A camshaft phaser as in claim 1 wherein said seating surface is dome-shaped.

3. A camshaft phaser as in claim 1 wherein said guiding walls are evenly spaced around said check valve body.

4. A camshaft phaser as in claim 3 wherein:

said camshaft phaser attachment bolt includes a plurality of radial drillings extending radially through said camshaft phaser attachment bolt into said larger diameter bore in an evenly spaced pattern; and the number of said guiding walls is not evenly divisible by the number of said radial drillings.

5. A camshaft phaser as in claim 1 wherein a spring is provided for biasing said check valve body toward said shoulder and an inner surface of said clearance walls radially supports said spring.

6. A camshaft phaser as in claim 1 further comprising a check valve spring seat disposed within said larger diameter bore, said check valve spring seat comprising an annular shaped end face that faces toward said check valve body and limits travel of said check valve body when said check valve body is fully open; wherein an inside volume of said check valve body is in fluid communication with the outside of said check valve body.

7. A camshaft phaser as in claim 6 wherein fluid communication between said inside volume of said check valve body and the outside of said check valve body is provided by said clearance walls being radially inward of said annular shaped end face.

8. A camshaft phaser as in claim 1 wherein;

said camshaft phaser attachment bolt includes a radial drilling extending radially through said camshaft phaser attachment bolt into said smaller diameter bore;

a filter is disposed circumferentially around said camshaft phaser attachment bolt to filter oil entering said smaller diameter bore through said radial drilling.

9. A camshaft phaser for controllably varying the phase relationship between a crankshaft and a camshaft in an internal combustion engine, said camshaft phaser comprising:

a camshaft phaser attachment bolt threadably engageable into said camshaft to attach said camshaft phaser to said camshaft, said camshaft phaser attachment bolt having a stepped bore for communicating pressurized oil from said internal combustion engine to a valve spool, said stepped bore defined by a larger diameter bore, a smaller diameter bore, and a shoulder between said larger diameter bore and said smaller diameter bore;

a check valve assembly to prevent oil from being communicated from said valve spool to said internal combustion engine, said check valve assembly comprising a check valve body axially moveable within said larger diameter bore;

wherein said check valve body includes a plurality of azimuthally spaced guiding walls, a plurality of clearance walls separating said guiding walls, and a seating surface at one end of said guiding walls and said clearance walls for selectively seating with said shoulder to prevent fluid communication between said larger diameter bore and said smaller diameter bore, said guiding walls riding closely against said larger diameter bore and said clearance walls spaced inward from said larger diameter bore to allow oil to flow between said clearance walls and said larger diameter bore when said seating surface is not seated with said shoulder.

10. A camshaft phaser as in claim 9 wherein said seating surface is dome-shaped.

11. A camshaft phaser as in claim 9 wherein said guiding walls are evenly spaced around said check valve body.

12. A camshaft phaser as in claim 11 wherein:

said camshaft phaser attachment bolt includes a plurality of radial drillings extending radially through said camshaft phaser attachment bolt into said larger diameter bore in an evenly spaced pattern; and the number of said guiding walls is not evenly divisible by the number of said radial drillings.

13. A camshaft phaser as in claim 9 wherein a spring is provided for biasing said check valve body toward said shoulder and an inner surface of said clearance walls radially supports said spring.

14. A camshaft phaser as in claim 9 further comprising a check valve spring seat disposed within said larger diameter bore, said check valve spring seat comprising an annular shaped end face that faces toward said check valve body and limits travel of said check valve body when said check valve body is fully open; wherein an inside volume of said check valve body is in fluid communication with the outside of said check valve body.

15. A camshaft phaser as in claim 14 wherein fluid communication between said inside volume of said check valve body and the outside of said check valve body is provided by said clearance walls being radially inward of said annular shaped end face.

16. A camshaft phaser as in claim 9 wherein;

said camshaft phaser attachment bolt includes a radial drilling extending radially through said camshaft phaser attachment bolt into said smaller diameter bore;

a filter is disposed circumferentially around said camshaft phaser attachment bolt to filter oil entering said smaller diameter bore through said radial drilling.

17. A camshaft phaser for controllably varying the phase relationship between a crankshaft and a camshaft in an internal combustion engine, said camshaft phaser comprising:

a stepped bore for communicating pressurized oil from said internal combustion engine through said camshaft phaser, said stepped bore defined by a larger diameter bore, a smaller diameter bore, and a shoulder between said larger diameter bore and said smaller diameter bore; and a check valve assembly to prevent oil from being communicated from said camshaft phaser to said internal combustion engine, said check valve assembly comprising a check valve body axially moveable within said larger diameter bore;

wherein said check valve body includes a plurality of azimuthally spaced guiding walls, a plurality of clearance walls separating said guiding walls, and a seating surface at one end of said guiding walls and said clearance walls for selectively seating with said shoulder to prevent fluid communication between said larger diameter bore and said smaller diameter bore, said guiding walls riding closely against said larger diameter bore and said clearance walls spaced inward from said larger diameter bore to allow oil to flow between said clearance walls and said larger diameter bore when said seating surface is not seated with said shoulder.

18. A camshaft phaser as in claim 17 wherein said seating surface is dome-shaped.

19. A camshaft phaser as in claim 17 wherein said guiding walls are evenly spaced around said check valve body.

20. A camshaft phaser as in claim 19 wherein:

a plurality of radial drillings extend radially outward from said larger diameter bore in an evenly spaced pattern; and the number of said guiding walls is not evenly divisible by the number of said radial drillings.

21. A camshaft phaser as in claim 17 wherein a spring is provided for biasing said check valve body toward said shoulder and an inner surface of said clearance walls radially supports said spring.

22. A camshaft phaser as in claim 17 further comprising a check valve spring seat disposed within said larger diameter bore, said check valve spring seat comprising an annular shaped end face that faces toward said check valve body and limits travel of said check valve body when said check valve body is fully open; wherein an inside volume of said check valve body is in fluid communication with the outside of said check valve body.

23. A camshaft phaser as in claim 22 wherein fluid communication between said inside volume of said check valve body and the outside of said check valve body is provided by said clearance walls being radially inward of said annular shaped end face.

* * * * *